US009545142B2

(12) United States Patent
Pitchforth et al.

(10) Patent No.: US 9,545,142 B2
(45) Date of Patent: Jan. 17, 2017

(54) HANDLE FOR CARRYING BAG

(71) Applicant: Eddie Bauer LLC, Bellevue, WA (US)

(72) Inventors: Noah Pitchforth, Issaquah, WA (US); Jesse Thompson, North Bend, WA (US); Brian Fletcher, North Bend, WA (US)

(73) Assignee: Eddie Bauer LLC, Bellevue, WA (US)

( * ) Notice: Subject to any disclaimer, the term of this patent is extended or adjusted under 35 U.S.C. 154(b) by 0 days.

(21) Appl. No.: 14/689,459

(22) Filed: Apr. 17, 2015

(65) Prior Publication Data

US 2015/0296949 A1 Oct. 22, 2015

Related U.S. Application Data

(60) Provisional application No. 61/981,026, filed on Apr. 17, 2014.

(51) Int. Cl.
*A45F 5/10* (2006.01)
*A45C 13/22* (2006.01)
*A45C 13/26* (2006.01)

(52) U.S. Cl.
CPC ..... *A45C 13/26* (2013.01); *A45F 5/1046* (2013.01)

(58) Field of Classification Search
CPC ... A45C 13/22; A45C 13/26; A45C 2013/223; A45C 5/10; A45F 5/10; A45F 5/1046; A45F 5/102; A45F 5/1026; A45F 2005/1006; A45F 2005/1013; A45F 2005/1033; B65D 33/06
USPC ..... 16/406, 411, 114.1; 244/251; 294/171
See application file for complete search history.

(56) References Cited

U.S. PATENT DOCUMENTS 308,052 A * 11/1884 Brooke ..... A45F 5/10 188/65.4
946,850 A * 1/1910 Tabler ..... A45F 5/10 294/149
1,268,775 A * 6/1918 Stanger ..... A45F 5/1046 16/411
1,742,867 A * 1/1930 Levi ..... A45C 13/26 16/114.1
1,808,890 A * 6/1931 Grant ..... A45C 13/22 16/406
2,425,245 A * 8/1947 Johnson ..... B25D 17/043 16/422

(Continued)

FOREIGN PATENT DOCUMENTS

FR 2661323 A1 * 10/1991 ..... A45F 5/1046

OTHER PUBLICATIONS

"Silicon Handle," Oempromo.com, Feb. 12, 2014, available at www.oempromo.com/product.Handles/S/Silicon-Handle-264984.html, 1 page.

(Continued)

*Primary Examiner* — Emily Morgan
(74) *Attorney, Agent, or Firm* — Sheridan Ross P.C.

(57) ABSTRACT

A handle for a luggage item is provided with at least one channel or conduit for receiving a strap for a duffel bag or similar luggage item. The handle is capable of selectively receiving at least one strap and further capable of being provided around or otherwise secured to a second strap. The handles may be used for single-handed carry of two or more straps and allow for the release or separation of the two or more straps as desired.

5 Claims, 5 Drawing Sheets

(56) References Cited

U.S. PATENT DOCUMENTS 2,444,558 A * 7/1948 Elliott ..... A45F 5/1046 16/411
2,528,239 A * 10/1950 McVay ..... A45F 5/1046 16/406
3,243,020 A * 3/1966 Friedlander ..... A45C 13/26 16/114.1
3,400,870 A * 9/1968 Di Vietri ..... A45C 13/30 16/406
3,486,684 A * 12/1969 Wilson ..... B65D 33/12 16/411
3,680,752 A * 8/1972 Wilson ..... A45F 5/10 294/171
5,029,926 A * 7/1991 Dieterich, Jr. ..... A45F 5/1046 16/411
5,996,180 A * 12/1999 Eisenzopf ..... A45C 13/22 150/107
6,049,948 A * 4/2000 Leonardi ..... A45F 5/10 16/422
6,217,095 B1 * 4/2001 Yamada ..... A45C 13/26 16/114.1
6,290,040 B1 9/2001 Chen
6,338,180 B1 * 1/2002 Massard ..... A45C 13/26 16/110.1
6,536,078 B2 * 3/2003 Tsai ..... A45C 5/02 16/114.1
6,658,698 B2 * 12/2003 Chen ..... A45C 13/26 16/111.1
6,901,635 B1 * 6/2005 Scola ..... A45F 5/1026 16/114.1
9,027,206 B2 * 5/2015 Guyoton ..... A63C 11/222 16/114.1
2003/0009847 A1 1/2003 Godshaw et al.
2003/0160078 A1 * 8/2003 Godshaw ..... A45F 3/14 224/607
2006/0137950 A1 6/2006 Nassanian
2006/0163894 A1 7/2006 Mishek et al.
2007/0000089 A1 * 1/2007 Morales ..... A44B 15/005 16/114.1
2008/0260300 A1 10/2008 Zabian
2010/0052349 A1 * 3/2010 Naeve ..... A45C 13/26 294/140
2011/0000942 A1 1/2011 Slockbower

OTHER PUBLICATIONS

U.S. Appl. No. 29/488,345, filed Apr. 17, 2014, Pitchforth et al.
International Search Report and Written Opinion for International (PCT) Patent Application No. PCT/US15/26360, mailed Jul. 20, 2015, 15 pages.

* cited by examiner

SECTION B-B

HANDLE FOR CARRYING BAG

This U.S. Non-Provisional patent application claims priority to and the benefit of U.S. Provisional Patent Application 61/981,026, filed Apr. 17, 2014, the entire disclosure of which is hereby incorporated by reference.

FIELD

The present disclosure relates generally to handles. More specifically, embodiments of the present disclosure relate to handles for one or more straps of a carrying bag, such as duffel bags and the like.

BACKGROUND

Various embodiments of the present disclosure relate to a luggage handle or luggage handle wrap adapted for use in combination with double carry handles for duffels and other luggage. Duffle bags and other luggage often utilize a pair of carry handles or straps made from fabric or similar flexible material. Each handle is attached separately to a side of the duffle, for example. The handles are separate in order to permit access to a zipper opening in the top of the duffle or luggage item. To hold and transport the duffle, one may grasp the two handles or straps simultaneously.

Known handle constructions generally comprise a luggage handle wrap which is attached to one of the handles or straps and is designed to wrap around the second handle or strap in order to form a convenient means to grip the handles together for ease of carrying, and maintain the straps or handles in a generally conjoined position. The wrap may be detached from engagement with at least one of the handles so as to enable the handles to be separated thereby permitting ease of access to the duffle or luggage item. Though such constructions have been available, there has remained the need for an improved luggage handle wrap having improved comfort and ease of assembly and use.

SUMMARY

Accordingly, there exists a long felt and unmet need to provide a luggage handle or wrap for luggage straps that provides enhanced ease of use, assembly, and manufacture. Embodiments of the present disclosure provide an improved handle for luggage, including duffel bags and the like. Although various embodiments contemplate providing handles as shown and described herein in combination with luggage, it will be recognized that the present disclosure is not limited to such uses or combinations.

In one aspect of the present invention, a handle for a luggage item is provided, the handle comprising a body portion, the body portion comprising a first end and a second end with an elongate length extending between the first end and the second end. A first channel extends between the first end and the second end, and the first channel comprises a first opening at the first end and a second opening at the second end, the openings of the first channel adapted to receive a strap of a luggage item. A second channel extends between the first end and the second end, wherein the second channel comprises a first opening at the first end and a second opening at the second end, the opening of the second channel adapted to receive a strap of a luggage item. The first channel comprises a substantially enclosed channel, and the second channel comprising an opening extending along the elongate length. A divider member is provided between the first channel and the second channel, wherein the divider member comprises an aperture for securing a first strap to the handle.

In another aspect of the present invention, a handle for a luggage item is provided, the handle comprising a body portion, the body portion comprising a first end and a second end with an elongate length extending between the first end and the second end, a first channel extending between the first end and the second end, wherein the first channel comprises a first opening at the first end and a second opening at the second end, the openings of the first channel adapted to receive a strap of a luggage item. A second channel extends between the first end and the second end, wherein the second channel comprises a first opening at the first end and a second opening at the second end, the openings of the second channel adapted to receive a strap of a luggage item. The second channel comprises an arcuate outer surface with an opening extending along the elongate length, and the arcuate outer surface comprising a first lip and a second lip, the first lip and the second lip provided in opposing relationship with respect to the opening and wherein at least one lip comprises at least one of a flexible and a biased material.

In yet another embodiment, a handle for a luggage item is provided, the handle comprising a body portion, the body portion comprising a first end and a second end with an elongate length extending between the first end and the second end, a channel extending between the first end and the second end, wherein the channel comprises a first lateral opening at the first end and a second lateral opening at the second end, the lateral openings of the channel adapted to receive a strap of a luggage item. The channel comprises an outer surface with an elongate opening extending along the elongate length, and the outer surface comprising a first lip and a second lip, the first lip and the second lip provided in opposing relationship with respect to the elongate opening and wherein at least one lip comprises a flexible material such that the elongate opening can be selectively deformed.

It is an object of embodiments of the present disclosure to provide a molded handle item that comprises an ergonomic user interface and facilitates connection between at least two straps. In one embodiment, the handle is secured or affixed to one strap, and comprises features for receiving at least a second strap. In various embodiments, the handle comprises a resilient or elastic member that generally retains a predetermined shape until acted upon by a force such as may be applied by a user.

It is another object of embodiments of the disclosure to provide a handle that is secured to a first strap and selectively and reliably retains a second strap when desired. In certain embodiments, the handle comprises a first channel that is fully enclosed and through which a first strap is provided or threaded. The handle comprises a second channel with an elongated slot for receiving a second strap. In various embodiments, the first strap is tethered or secured to the handle to prevent the handle from sliding or translating along the length of the first strap.

It is yet another object of embodiments of the present disclosure to provide a handle that is lightweight, comfortable to grasp, and efficient to manufacture. Handles of the present disclosure may be formed of various suitable materials, including but not limited to rubber, thermoplastic polyurethane (TPU), polyxymethylene (acetyl) or aliphatic polyamides (nylon) to name a few.

It is yet another object of embodiments of the present disclosure to provide a handle that is capable of selectively securing straps without the use of a hook and loop closure or flap, as provided in various prior art devices.

Accordingly, the present disclosure contemplates a novel luggage handle that is selectively attached to at least one strap of a luggage item. These and other advantages and features will be set forth in the detailed description which follows.

In certain embodiments, the present disclosure provides a handle device for a luggage item wherein the handle device comprises only one channel portion for receiving a strap. In one embodiment, a first strap such as a flexible duffel strap is secured to the handle device and substantially fixed thereto. The handle device comprises an interior volume and at least one longitudinally extending opening or slot for selectively receiving a second strap. In such embodiments, the handle device is devoid of a minor channel as shown and described herein and comprises a main or major channel with one strap secured or securable to the handle by various means as will be recognized by one of skill in the art, and at least one additional strap being selectively receivable within an interior volume of the handle to facilitate carrying of at least two straps with one hand of a user.

This summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

Those of skill in the art will recognize that the following description is merely illustrative of the principles of the disclosure, which may be applied in various ways to provide many different alternative embodiments. This description is made for illustrating the general principles of the teachings of this disclosure and is not meant to limit the inventive concepts disclosed herein.

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1:
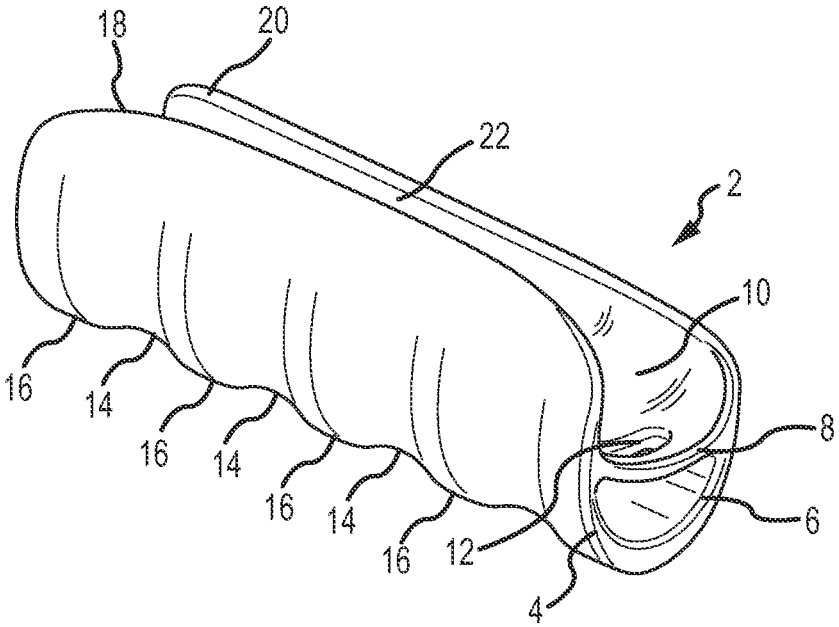

FIG. 1 is a perspective view of one embodiment of a luggage handle according to one embodiment of the present disclosure.

Figure 2:
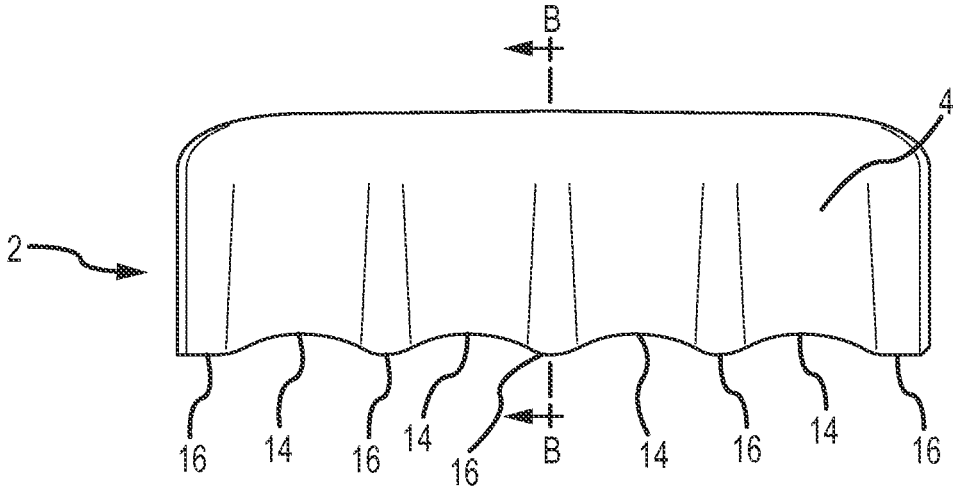

FIG. 2 is an elevation view of a luggage handle according to one embodiment of the present disclosure.

Figure 3:
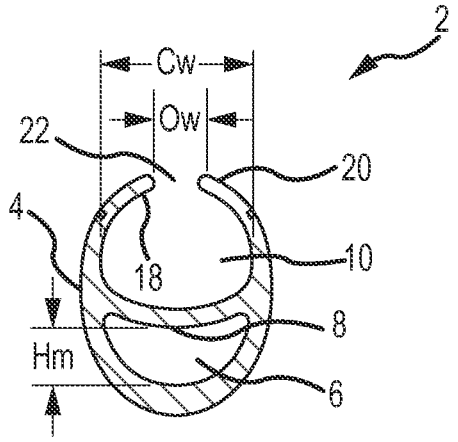

FIG. 3 is a cross-sectional side elevation view of a luggage handle according to one embodiment of the present disclosure.

Figure 4:
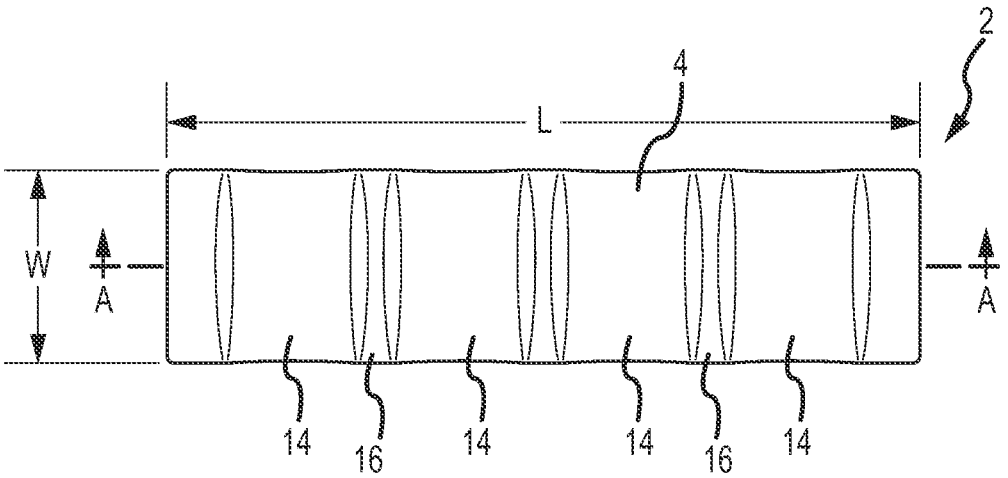

FIG. 4 is a bottom plan view of a luggage handle according to one embodiment of the present disclosure.

Figure 5:
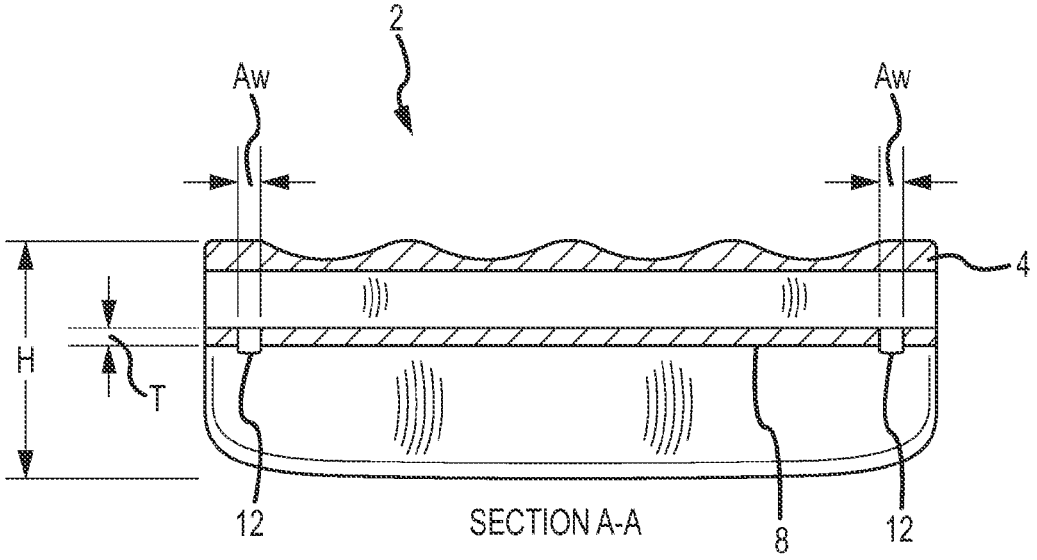

FIG. 5 is a cross-sectional elevation view of a luggage handle according to one embodiment of the present disclosure.

Figure 6:
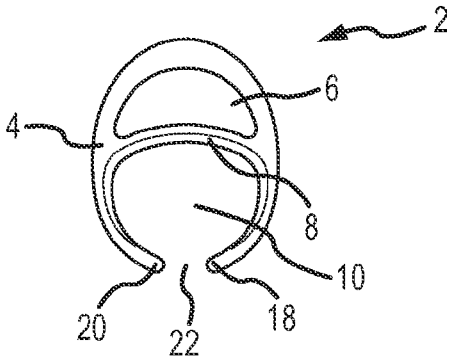

FIG. 6 is a side elevation view of a luggage handle according to one embodiment of the present disclosure.

Figure 7:
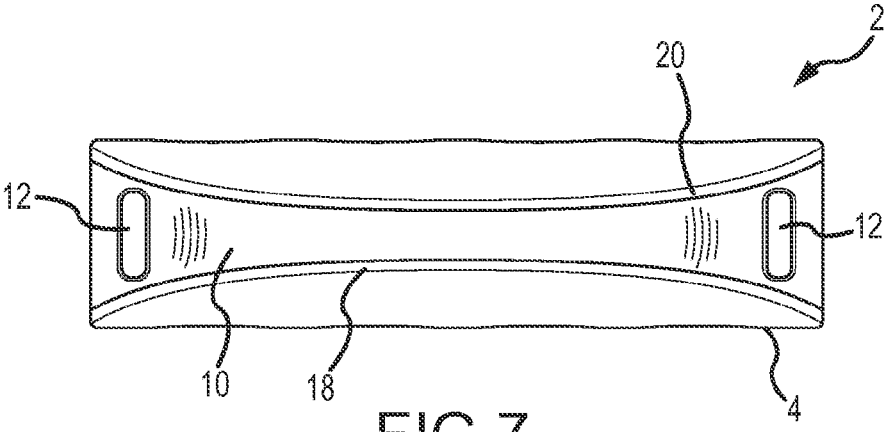

FIG. 7 is a top plan view of a luggage handle according to one embodiment of the present disclosure.

Figure 8:
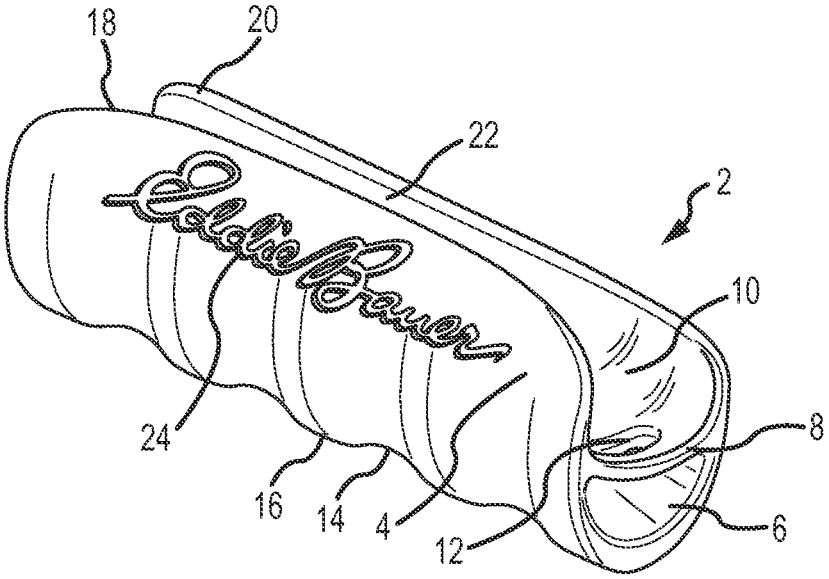

FIG. 8 is a perspective view of one embodiment of a luggage handle according to one embodiment of the present disclosure.

Figure 9:
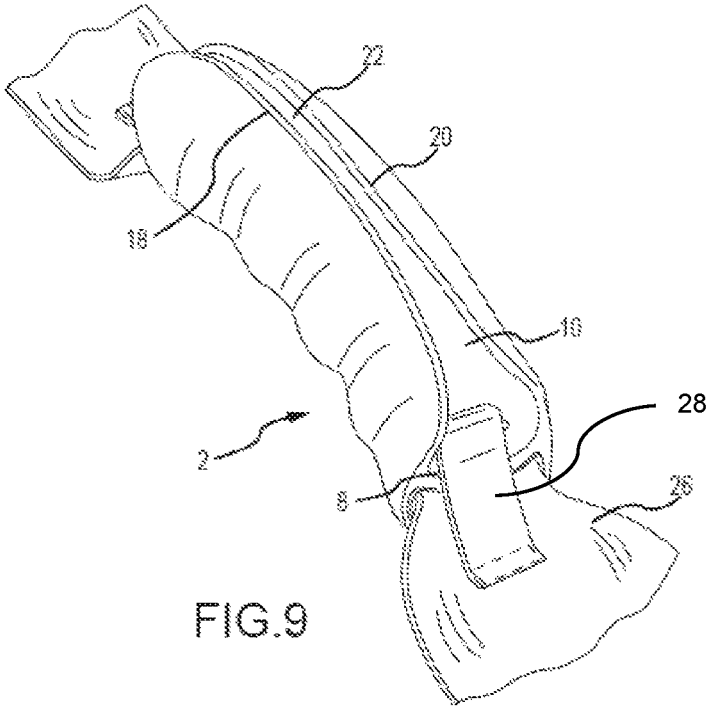

FIG. 9 is a perspective view of one embodiment of a luggage handle according to one embodiment of the present disclosure.

DETAILED DESCRIPTION

Embodiments of the present disclosure have significant benefits across a broad spectrum of endeavors. Referring now to FIGS. 1-8, a luggage handle according to various embodiments of the present disclosure is shown. FIG. 1 is a perspective view of a luggage handle 2 according to one embodiment of the present disclosure. The handle 2 comprises a body portion 4, which may be made of any number of suitable materials, including silicon and various rubbers or plastics. The handle 2 is not limited to any particular size or dimensions, but is preferably large enough to receive a human hand. In the depicted embodiment, finger grip portions are provided along a lower edge of the handle 2, the finger grip portions are generally defined by peaks 14 and troughs 16 so as to form successive and substantially parallel finger-receiving portions. The handle 2 comprises a major channel 10 and a minor channel 6. The minor channel 6 comprises a channel 6 that is closed along its length, with the exception of apertures 12 and openings at its lateral ends. The major channel 10 is provided substantially adjacent to and preferably above the minor channel 6. In alternative embodiments, however, it is contemplated that the major channel 10 may be laterally adjacent to, below, or offset with respect to the minor channel 6. The minor channel 6 is adapted and provided to receive a strap of a bag, such as a duffel bag carrying strap, wherein the strap (not shown) is passed through the minor channel 6 and secured to the bag such that the strap is not removable from the minor channel 6 unless the minor channel 6 or strap is cut, damaged, severed, etc. In certain embodiments, the handle 2 is translatable along a trap by virtue of the strap simply being threaded or passed through the minor channel 6. In alternative embodiments, at least one strap of a bag is secured to the handle 6 such that the handle 2 is provided in a substantially fixed position relative to at least one strap.

The major channel 10 is provided to selectively receive a second strap of the luggage item. The major channel 10 is separated from the minor channel 6 by a divider 8. The divider 8 preferably extends substantially the entire length of the minor 6 and/or major channel 10. In the depicted embodiment, an upper portion of the handle 2 comprises an elongate slot or opening 22 bounded by upper edges 18, 20, which are contemplated as being in the form of a first lip and a second lip in the depicted embodiment, of the handle. In a preferred embodiment, at least portions of the handle 2 include upper edges or lips 18, 20 and comprise a substantially rigid material, such as TPU. Alternative embodiments comprise flexible materials such that various portions of the handle are elastically deformable. Although the depicted embodiment of FIG. 1 provides the opening 22 provided on an upper portion of the handle 2, the present disclosure is not so limited. Indeed, the opening 22 may be provided in any number of locations along an outer periphery of the handle 2.

FIG. 2 is a front elevation view of the handle 2 of the embodiment of FIG. 1. As shown, the handle 2 comprises a body portion 4 and a plurality of fingerwell portions defined by peaks 14 and troughs 16. In alternative embodiments, the handle 2 is devoid of fingerwell portions, and is either flat or arcuate along a lower portion of the device.

FIG. 3 is a cross-sectional elevation view of a handle 2 according to one embodiment, and taken along line B-B of FIG. 2. As shown, the handle 2 comprises an opening 22 provided at an upper portion of the handle 2 wherein the opening comprises a width Ow of approximately 7.66 mm. In various embodiments, the width Ow of the opening 22 comprises a width between approximately 2 and 20 mm. It will be recognized, however, that depending on the desired application and strap(s) to be provided with the handle 2, this width and various dimensions of the handle 2 may vary. In preferred embodiments, the width of the opening 22 comprises a width Ow between approximately 5 mm and 10 mm. The opening 22 is positioned along the major channel 10 as shown. The major channel 10 comprises a maximum channel width Cw that is larger than the opening 22. In various embodiments, the maximum width Cw of the major channel 10 comprises a width between approximately 5 mm and 40 mm. In preferred embodiments, the maximum width Cw of the major channel 10 comprises a width between approximately 15 mm and 25 mm. In the depicted embodiment, a maximum width Cw of the major channel comprises a width of approximately 22.18 mm. The minor channel 6 is provided beneath the major channel 10 and is separated therefrom by a divider 8 as shown. In various embodiments, the minor channel 6 comprises a maximum width that is substantially similar to a maximum width of the major channel 10. In various embodiments, the maximum width of the minor channel 6 comprises a width between approximately 5 mm and 40 mm. In preferred embodiments, the maximum width of the minor channel 6 comprises a width between approximately 15 mm and 25 mm. In the depicted embodiment, a maximum width of the minor channel 6 comprises a width of approximately 21.16 mm. Additionally, the minor channel 6 comprises a maximum height Hm of between approximately 5 and 15 mm. In the depicted embodiment, the minor channel 6 comprises a height Hm of approximately 8.54 mm.

As shown in FIG. 4, the handle 2 comprises a width W of approximately 27.78 mm. In various embodiments, the handle 2 comprises a width W of between approximately 10 and 50 mm. In preferred embodiments, the handle 2 comprises a width W of between approximately 20 and 30 mm. The length L of the handle in FIG. 4 is depicted as being approximately 107.8 mm. In various embodiments, the handle 2 comprises a length L of between approximately 50 and 150 mm. In preferred embodiments, the handle 2 comprises a length L of between approximately 90 and 120 mm.

FIG. 5 is a cross-sectional view of the handle 2 of FIG. 4 and taken along line A-A. As shown, a pair of apertures 12 is provided in the divider 8 of the handle 2. The apertures 12 provide means for securing the handle 2 to a strap (not shown) of a luggage item. For example, where the luggage handle 2 is provided with a duffel bag, one of two straps for hand carry of the bag is provided through the minor channel 6. To prevent the handle 2 from sliding along the length of the strap threaded through the minor channel 6, connection straps are looped through each of the apertures 12 and secured back to the hand carry strap. In this manner, the handle 2 is tethered to the hand carry strap at both of the lateral ends of the handle 2 such that the handle 2 is substantially prevented from sliding along the length of the hand carry strap.

In alternative embodiments, the handle 2 is not generally secured along a length of a strap, and the strap is simply threaded through the minor channel 6 and the handle 2 is allowed to slide along the length of the strap. In further embodiments, the handle 2 is substantially fixed along a length of the strap by one or more structures provided on the strap adjacent the handle 2. For example, in one embodiment, one or more knots, orbs, plates, washers, and/or various combinations thereof are provided adjacent the handle 2, such features comprising a dimension equal to or larger than an opening of the minor channel 6 such that translation of the handle 2 is substantially prevented. In further embodiments, the handle 2 is secured to at least one strap by adhering the strap to the interior of the minor channel 6. In further embodiments, a strap is provided in the minor channel 6 wherein the minor channel 6 comprises a peripheral opening similar to that shown and described with respect to the major channel 10.

As shown in FIG. 5, a thickness T of the divider 8 is approximately 2.57 mm. In various embodiments, the thickness T of the divider 8 comprises a thickness of between approximately 1 and 10 mm. In preferred embodiments, the thickness T of the divider 8 is between approximately 1 and 4 mm. An overall height H of the handle 2 is approximately 35 mm, as shown in FIG. 5. The width of the apertures Aw 12 is approximately 3.46 mm. It will be recognized, however, that these dimensions are provided as exemplary only and that handles and handle features of various sizes and proportions are within the scope and spirit of the present disclosure.

FIG. 6 is a side elevation view of a handle 2 according to one embodiment of the present disclosure. The handle 2 is shown in an orientation with the major channel 10 and opening 22 disposed at a lower portion of the handle. Although preferred embodiments contemplate that these features are provided at an upper portion of the handle, and above the minor channel 6, various orientations are contemplated.

FIG. 7 is a top plan view of the handle 2, revealing a spacing of the apertures 12 as shown and described herein. FIG. 8 is a perspective view of one embodiment of the present disclosure as shown and described herein and wherein a logo or indicia 24 is provided on the handle 2. As shown, a company name or logo may be provided on the handle 2, either by molding the indicia 24 or otherwise applying visual information to the handle 2.

FIG. 9 is a perspective view of one embodiment of a handle 2 with a luggage strap 26 provided through the minor channel 6 of the handle. As shown, at least one securing strap 28 is provided. In the depicted embodiment, the securing strap 28 is looped through an aperture 12 in the divider 8 and secured back to the luggage strap 26. The handle 2 is thus provided in a substantially fixed position relative to the luggage strap 26. The length of the securing strap 28 and tightness of the loop formed dictates the amount of play or movement the handle 2 will have relative to the luggage strap 26.

In one embodiment, the void space provided by the minor channel 6 of the handle 2, and the flexibility of the body 4, enables at least a portion of the handle 2 to deform and/or conform to the hand of a user when held or carried. The void space of the minor channel 6 preferably comprises a volume that enables at least some deformation of the outer surface of the body 4.

As also shown in FIG. 9, an opening 22 is provided at or proximal the upper portion of the handle 2. The opening 22 is bounded by upper edges 18, 20 of the handle 2. In a preferred embodiment, the handle comprises a substantially rigid member wherein the upper edges 18, 20 are substantially fixed and rigid to avoid pinching of a user's hand when the handle is grasped and/or the bag is carried. In such preferred embodiments, the strap that is not threaded through the minor channel 6 of the handle 2, but may be threaded or inserted into the major channel 10 of the handle 2. In alternative embodiments, the upper edges 18, 20 comprise flexible, resilient, and/or elastic members that allow for deformation of the handle 2 and opening 22 such that a second strap (not shown) may be selectively inserted into the major channel 10 and wherein upper edges 18, 20 retain their original shape after deformation and/or insertion. In various embodiments, the second strap is substantially secured within the major channel 10 of the handle 2, facilitating carrying and movement of the bag. The strap may be removed by an application of force to the handle and/or the strap.

In further embodiments, a second strap of a luggage item comprises an ironed or rigid, flat portion that is provided and adapted for inserting through the opening 22. In various alternative embodiments, biasing forces of the strap orient the ironed or rigid, flat portion within the major channel 10 of the handle 2 such that removal of the strap is generally restricted, at least without a user applying a force to rotate the strap to a specific orientation. The strap may be naturally biased (e.g. through its construction, fabric, and orientation) or may be provided with biasing elements such as springs.

While various embodiments of handle devices have been described in detail, it is apparent that modifications and alterations of those embodiments will occur to those skilled in the art. However, it is to be expressly understood that such modifications and alterations are within the scope and spirit of the present disclosure. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A handle for a luggage item, the handle comprising:

a body portion having a first end and a second end with an elongate length extending therebetween;

a first strap and a second strap configured to support the luggage item, a first channel extending between the first end and the second end, wherein the first channel comprises a substantially enclosed channel with a first opening at the first end and a second opening at the second end, and the first strap extending through the first channel;

a second channel extending between the first end and the second end, wherein the second channel comprises a first opening at the first end and a second opening at the second end, the openings of the second channel adapted to receive the second strap;

a divider extending along the elongate length between the first channel and the second channel, and wherein the divider comprises at least one aperture;

securing strap extending through the at least one aperture, w wherein the securing strap comprises a first end and a second end and wherein the first end and the second end are secured to the first strap to substantially prevent movement of the handle with respect to the first strap;

the second channel comprising an arcuate outer surface with an elongate slot extending along the elongate length, the arcuate outer surface comprising a first lip and a second lip, said first lip and said second lip provided in opposing relationship with respect to the elongate slot and wherein at least one lip comprises a flexible material for selectively receiving the second strap and wherein the second strap is selectively removable from the second channel.

2. The handle of claim 1, wherein the handle comprises at least one of a thermoplastic polyurethane, a silicone, a silicone rubber, a rubber, a polyethylene, a phenolic material, and a thermoplastic material.

3. The handle of claim 1, wherein at least a portion of the elongate slot extending along the elongate length comprises a partially elastic material.

4. The handle of claim 1, wherein the first channel is smaller than the second channel.

5. A luggage item comprising:

the luggage item comprises a first strap and a second strap; and a handle comprising a body portion;

the body portion comprising a first end and a second end with an elongate length extending between the first end and the second end;

a major channel extending between the first end and the second end, wherein the major channel comprises a first opening at the first end and a second opening at the second end, the openings of the major channel adapted to receive the first strap of the luggage item;

the major channel comprising an outer surface with an elongate opening extending along the elongate length, and the outer surface comprising a first lip and a second lip, said first lip and said second lip provided in opposing relationship with respect to the elongate opening and wherein at least one of said first lip and said second lip comprises a flexible material such that the elongate opening can be selectively deformed;

a minor channel extending adjacent to the major channel, the second strap extends through the minor channel, wherein the minor channel and the major channel are at least partially separated by a divider; and a first aperture and a second aperture provided in the divider, and a securing strap, the securing strap comprises a first end and a second end, the securing strap extends through the first aperture and the first and second ends of the securing strap are secured to the second strap to substantially prevent movement of the handle with respect to at least the second strap of the luggage item.

* * * * *